United States Patent [19]

Eckstein

[11] Patent Number: 4,595,093

[45] Date of Patent: Jun. 17, 1986

[54] PACKAGE OF COMPRESSED RESILIENT ARTICLES AND CONCOMITANT METHOD OF UNPACKAGING

[75] Inventor: Joseph H. Eckstein, Sunman, Ind.

[73] Assignee: The Procter & Gamble Company, Cincinnati, Ohio

[21] Appl. No.: 568,853

[22] Filed: Jan. 6, 1984

[51] Int. Cl.[4] ..... B65D 71/06

[52] U.S. Cl. ..... 206/44 R; 53/436; 206/83.5; 206/391; 206/394; 383/78; 383/121

[58] Field of Search ..... 206/44 R, 44.12, 45.19, 206/45.33, 83.5, 216, 389-395, 413, 417, 497, 577, 45.2, 45.22, 45.26, 225, 407, 408, 410, 442, 443, 445, 526, 581, 812, 823, 824; 229/41 R, 87 F, 87 R; 383/78-83, 121; 53/436, 438, 439, 441, 442, 447, 449

[56] References Cited

U.S. PATENT DOCUMENTS

| | | | |
|---|---|---|---|
| 2,441,513 | 5/1948 | Schmitt | 53/449 |
| 2,652,972 | 9/1953 | Davis | 229/55 |
| 2,678,768 | 5/1954 | Vergobbi | 229/55 |
| 2,757,500 | 8/1956 | Heinl et al. | 53/392 |
| 2,817,474 | 12/1957 | Abramson | 229/57 |
| 3,117,513 | 1/1964 | Burnett et al. | 100/215 |
| 3,148,769 | 9/1964 | Bryant | 206/45.33 |
| 3,164,350 | 1/1965 | Taub | 206/44 R |
| 3,340,998 | 9/1967 | Wilson | 206/44 R |
| 3,381,817 | 5/1968 | Harm | 206/391 |
| 3,402,475 | 9/1968 | Johansen et al. | 53/442 |
| 3,493,107 | 2/1970 | Markey | 206/497 |
| 3,587,201 | 6/1971 | Strayer | 53/438 |
| 3,628,656 | 12/1971 | Knuchel | 206/46 R |
| 3,826,363 | 7/1974 | Amneus | 206/430 |
| 3,872,967 | 3/1975 | Brush | 206/45.33 |
| 4,108,063 | 8/1978 | Randolph | 100/53 |
| 4,290,525 | 9/1981 | Sisson | 383/121 |

*Primary Examiner*—William Price
*Assistant Examiner*—Jimmy G. Foster
*Attorney, Agent, or Firm*—Thomas J. Slone; Fredrick H. Braun; Richard C. Witte

[57] ABSTRACT

A package wherein a compressed array of resilient articles and a convertible support panel are disposed in a constraining enclosure such as, for example, a bag made of thermoplastic film. The convertible support panel preferably functions as the bottom wall of the package to enhance stackability of such packages; and is convertible into a tray for displaying the array of expanded articles upon removal of the constraining enclosure. The method of unpackaging includes the steps of removing the convertible support panel from the package while maintaining the array of articles constrained by the constraining enclosure; erecting the convertible support panel to convert it into a display tray; placing the constrained array in the tray; and removing the constraining enclosure.

12 Claims, 14 Drawing Figures

PACKAGE OF COMPRESSED RESILIENT ARTICLES AND CONCOMITANT METHOD OF UNPACKAGING

DESCRIPTION

1. Technical Field

This invention pertains to a package wherein an array of compressed resilient articles are disposed on a support panel in a constraining enclosure; and wherein the support panel is convertible into a tray which is sufficiently large to display the array of articles after the constraining enclosure has been removed, and the articles have expanded to their unconstrained dimensions. The invention also pertains to concomitant methods of unpackaging such packages.

2. Background Art

A constraining package of resilient bulk material is, for example, disclosed in U.S. Pat. No. 4,108,063 which issued Aug. 22, 1978 to Arthur J. Randolph; and a constraining package of compressed insulation bats is disclosed in U.S. Pat. No. 3,117,513 which issued Jan. 14, 1964. Packages wherein an array of fixed-geometry articles is disposed on a support panel within a wrap or bag are, for example, disclosed in U.S. Pat. Nos. 2,652,972 which issued Sept. 22, 1953 to H. C. Davis; 2,817,474 which issued Dec. 24, 1957 to A. A. Abramson; 3,628,656 which issued Dec. 21, 1971 to Max Knuchel; 3,826,363 which issued July 30, 1974 to John S. Amneus et al; and 3,872,967 which issued Mar. 25, 1975 to John B. Brush. Additionally, U.S. Pat. No. 2,678,768 which issued May 18, 1954 to R. W. Vergobbi discloses a Reinforced Bag which is said to be self supporting by virtue of having a reinforcing member in or for the bottom part of the bag.

DISCLOSURE OF THE INVENTION

In accordance with one aspect of the invention, a package is provided wherein an aray of compressed resilient articles is disposed on a convertible support panel and so constrained by an enclosure: preferably, an enclosure made from sheet material such as thermoplastic film; and, more preferably, a thermoplastic bag. The support panel (preferably a folded panel of corrugated cardboard) preferably constitutes the bottom wall of the package, and is convertible (preferably by unfolding and then refolding) into a tray of sufficient size (preferably greater in plan size than the plan size of the support panel) to display the array of articles upon removal of the constraining enclosure and the resulting expansion of the resilient articles. The articles are preferably cylindrical-shape rolls of tissue paper products such as toilet tissue or paper towels; and, may be packages of sub-arrays of such products such as contemporary 4-roll and 6-roll packages. The method of unpackaging such packages and displaying such arrays preferably comprises the steps of: orienting the package so that the support panel faces upwardly; sufficiently opening the package to release the support panel from the enclosure while substantially maintaining the in-package level of constraint on the array of articles; erecting the support panel to convert it into a display tray; placing the display tray bottom-side-up over the upwardly facing bottom end of the opened package; righting the opened package and display tray as a unit; and removing the enclosure from about the array to enable the array of articles to expand in the display tray to the full unconstrained dimensions of the array of articles.

BRIEF DESCRIPTIONS OF THE DRAWINGS

While the specification concludes with claims which particularly point out and distinctly claim the subject matter regarded as forming the present invention, it is believed the invention will be better understood from the following description taken in conjunction with the accompanying drawings in which identical features in the several views are identically designated and in which:

Figure 1:
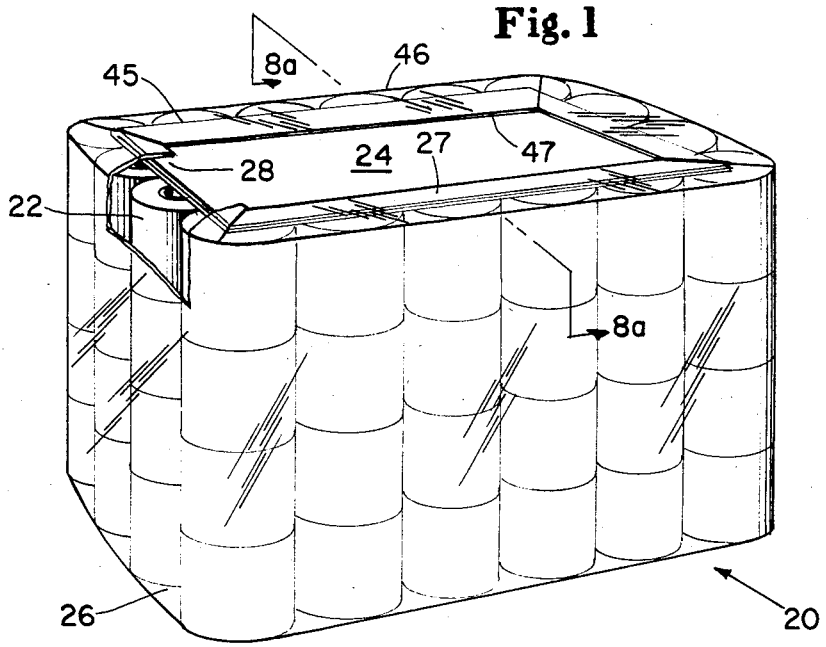
FIG. 1 is a perspective view of an inverted package embodying the present invention.
Figure 8A:
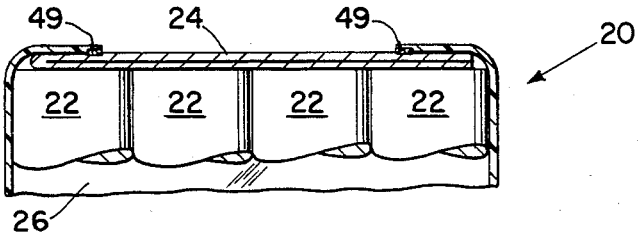

FIG. 8*a* is a fragmentary sectional view taken along line 8*a*—8*a* of FIG. 1.

Figure 7:
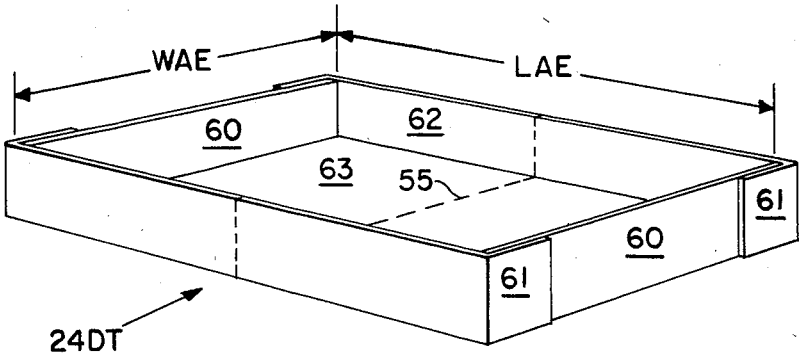
FIG. 7 is a perspective view of the support panel of FIG. 6 after the support panel has been converted into a display tray by first unfolding it, and then refolding it along different fold lines to erect it into a tray configuration.
Figure 8B:
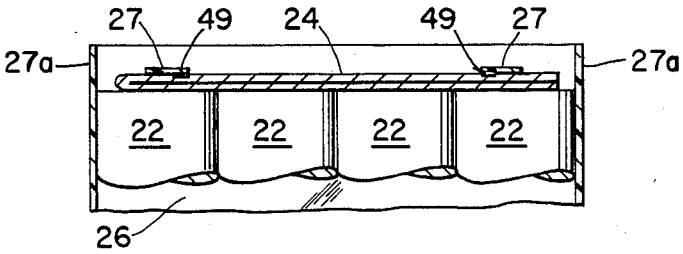
Figure 8C:
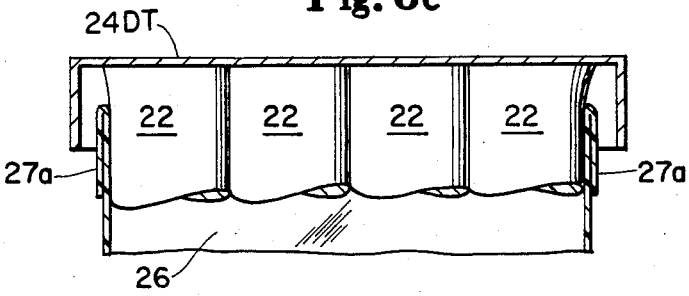
Figure 8D:
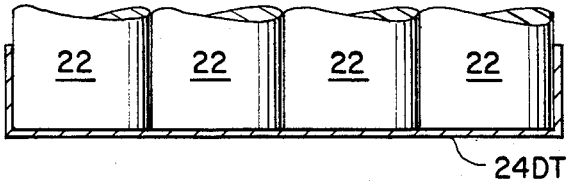

FIGS. 8*b*, 8*c*, and 8*d* are sequential fragmentary sectional views which depict the transition of the inverted package of FIG. 8*a* into an array of unconstrained resilient rolls of tissue paper disposed on a display tray of the configuration shown in FIG. 7.

Figure 9:
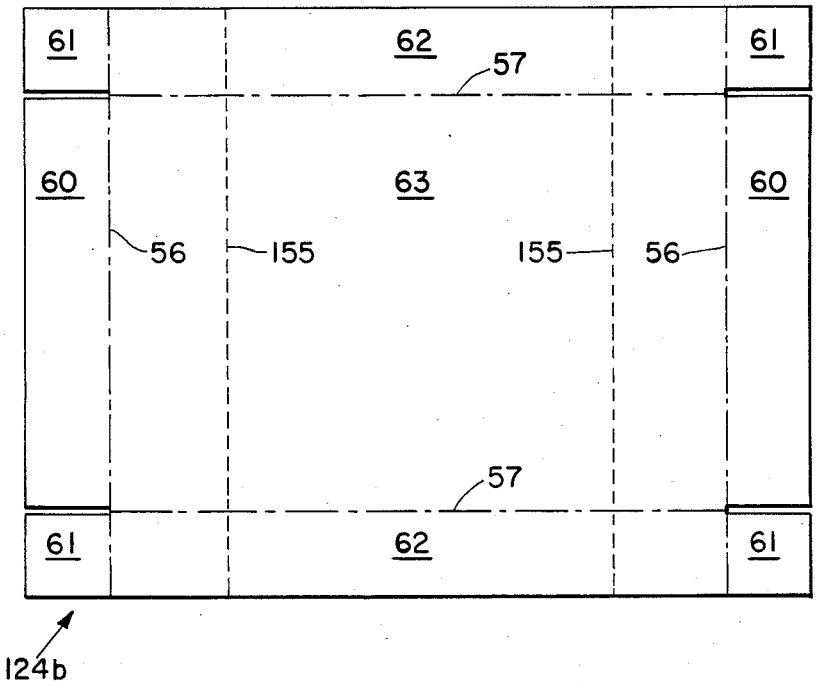

FIG. 9 is a plan view of a cut and scored blank for making an alternate embodiment support panel which can be converted into a display tray in accordance with the present invention.

Figure 10:
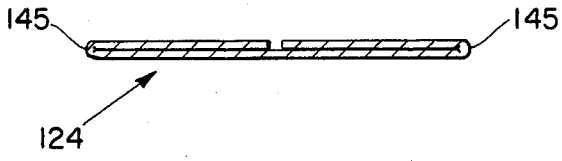

FIG. 10 is an edge view of the blank of FIG. 9 after it has been C-folded to form it into a convertible support panel in accordance with the present invention.

Figure 11:
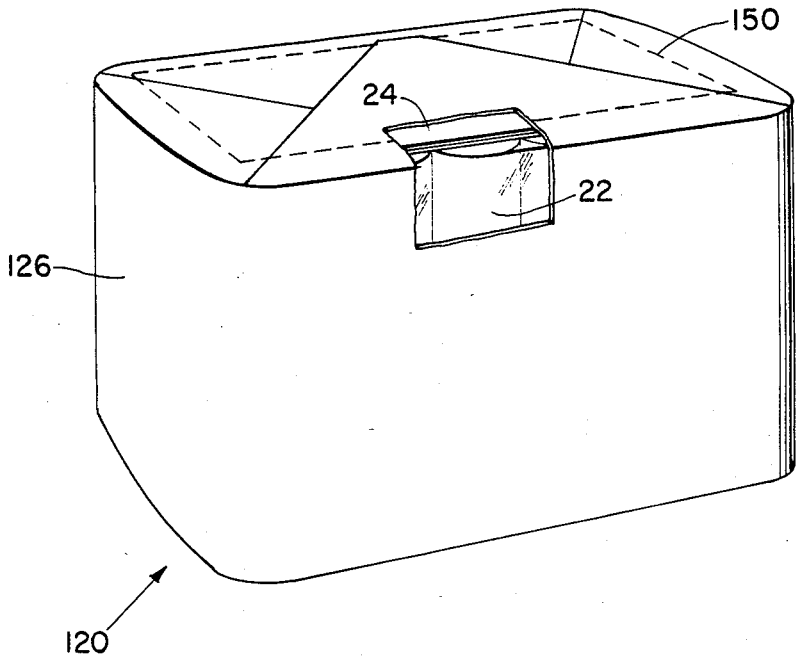

FIG. 11 is a perspective view of an inverted alternate package embodiment of the present invention.

DETAILED DESCRIPTION OF THE INVENTION

An exemplary package 20 which is an embodiment of the present invention is shown in FIG. 1 to comprise a four-by-four-by-six array of compressed resilient articles 22, a convertible support panel 24 which as shown is U-folded, and a constraining enclosure 26. As shown in FIG. 1, package 20 is inverted from its normal shipping orientation. Thus, the convertible support panel 24 which essentially forms the bottom wall of the package faces upwardly in FIG. 1. Also as shown in FIG. 1, the constraining enclosure 26 is preferably made of sheet material such as thermoplastic film. Indeed, most preferably, the constraining enclosure 26 is a thermoplastic bag (e.g., a bag formed from polyethylene film), and has edge areas 27 disposed adjacent its open end secured to outwardly facing marginal areas 28 of the convertible support panel 24. Additionally, in FIG. 1, the closed edge of support panel 24 is designated 45; the top-back edge of the package is designated 46; and the bottom-end-edge of enclosure 26 is designated 47.

Briefly, package 20 is made by compressing to a predetermined size a predetermined array of compressible resilient articles such as consumer rolls of toilet tissue; loading the array into a constraining enclosure such as a polyethylene bag by forcing the array through a loading funnel and into a compression and shape maintaining fixture; juxtaposing a folded convertible support panel against the bottom surface of the array; closing the package as by securing the open end edges of the enclosure to the outwardly facing surface of the convertible support panel; and finally removing the completed package from the fixture. Such a package wherein the contents is compressed and resilient—for example compressed to about eighty-five (85) percent of its uncompressed volume—reduces shipping and warehousing costs, as well as packaging materials costs. Additionally, substitution of a thermoplastic bag for a corrugated case further reduces the cost of packaging materials; and, provision of the convertible support panel which is convertible to a display tray enhances the stackability of such packages as well as providing a display tray for the unpackaged array of articles.

Figure 2:
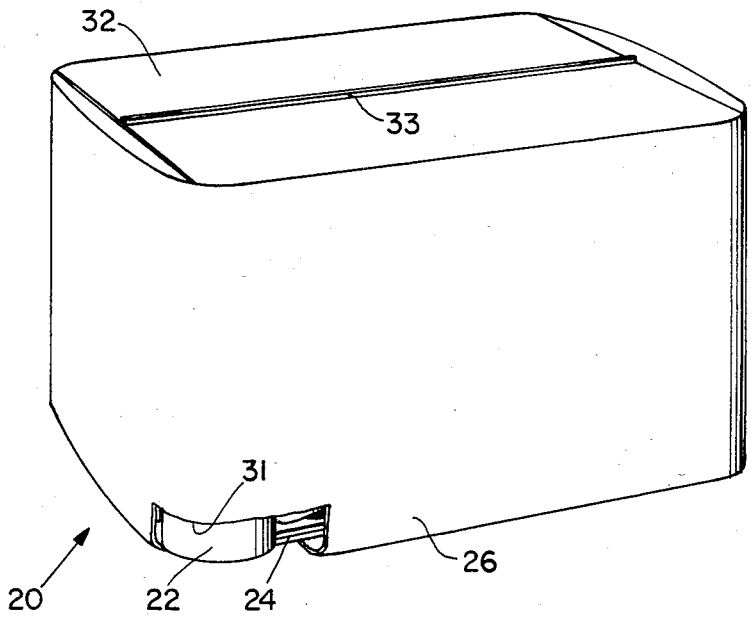
FIG. 2 is a perspective view of the package shown in FIG. 1 after it has been righted; oriented with its top end facing upwardly.

FIG. 2 is a perspective view of package 20, FIG. 1, after it has been righted from the orientation in FIG. 1. For simplicity, enclosure 26 of FIG. 2 is shown to be opaque rather than transparent as shown in FIG. 1 although it is not intended to thereby limit the present invention to either transparent or opaque enclosures. A fragmentary portion of enclosure 26 has been torn away along line 31 to show one of the articles 22 within the package; and to show that the convertible support panel 24 faces downwardly after such righting of package 20. The end 32 of enclosure 26 which faces upwardly in FIG. 2 is shown to be closed with a longitudinally extending seam 33. In embodiments of the invention wherein enclosure 26 is a thermoplastic bag, end 32 is the factory formed closed end of the bag. It is, however, not intended to thereby limit the present invention to either thermoplastic bags or to bags having this particular form of factory closed ends.

Figure 3:
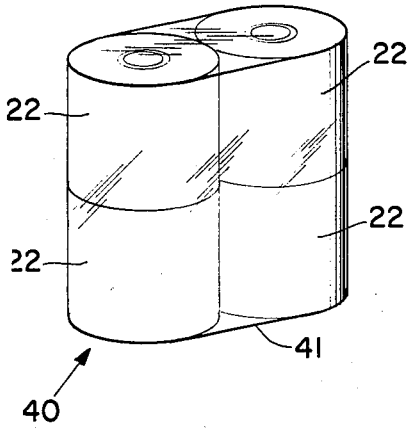
FIG. 3 is a perspective view of a contemporary 4-Pack of toilet tissue.

FIG. 3 is a perspective view of a contemporary 4-Pack 40 of toilet tissue rolls 22 disposed in a two-by-two sub-array in a wrap 41 of transparent thermoplastic film: for example, polyethylene film. Embodiments of the present invention may include such sub-array packs rather than only single articles per se. Importantly, however, such sub-array packs must be compressible and resilient as described hereinbefore with respect to articles 22 in order to realize the benefits of the present invention.

Figure 4:
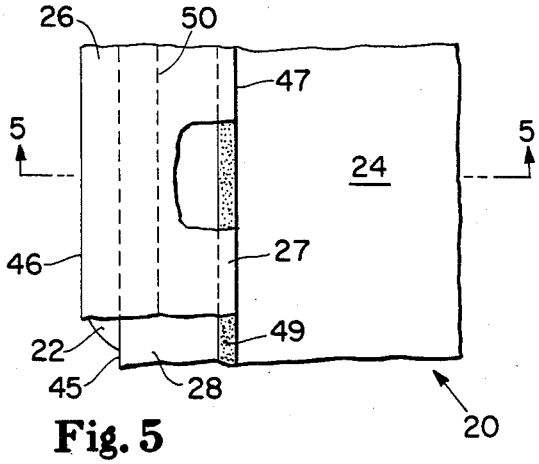
FIG. 4 is an enlarged scale plan view of a fragmentary portion of the bottom of the package shown in FIG. 2.

FIG. 4 is an enlarged scale fragmentary view of the bottom end of package 20. The longitudinal edge 45 of support panel 24 is disposed inboard of edge 46 of package 20, and outboard from edge 47 of enclosure 26. The edge area 27 of enclosure 26 is also shown to be secured to the subjacent marginal area 28 of support panel 24 with glue bead 49. The dotted line 50, FIG. 4, identifies a line which may be printed on enclosure 26 to read CUT ALONG THIS LINE TO REMOVE DISPLAY TRAY or the like. Thus, enclosure 26 may be cut along line 50 to enable removing support panel 24 from the package; and, by virtue of support panel 24 underlying line 50, the articles 22 in package 20 are protected from damage during such cutting. Alternatively, line 50 may be a line-of-weakening which may be torn to release the support panel. As more fully described hereafter, upon cutting or tearing along line 50, a residual rim-portion of enclosure 26 will remain attached to support panel 24; and the remaining portion of enclosure 26 can be peeled back to enable removal of support panel 24. Of course, however, the residual rim portion of enclosure 26 can also be rendered peelable from support panel 24 through the use of release coatings and compatible adhesives.

Figure 5:
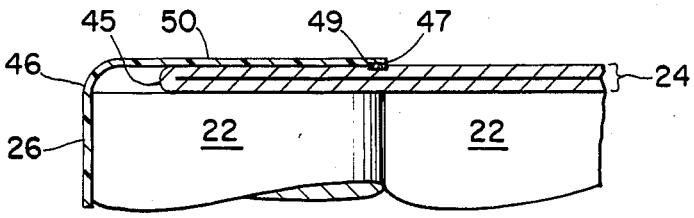
FIG. 5 is a fragmentary sectional view taken along line 5—5 of FIG. 4.

FIG. 5 is an enlarged scale sectional view of package 20 taken along line 5—5 of FIG. 4 to further illustrate the cooperative elements of package 20 described above. That is, in FIG. 5, edge 45 of support panel 24 is shown to be the edge formed by its being U-folded prior to inserting it in package 20. FIG. 5 also shows that edge 45 is disposed intermediate edge 46 of package 20 and edge 47 of enclosure 26; and that the marginal area of support panel 24 which is disposed between edges 45 and 47 underlies line 50 (the CUT ALONG HERE line) to protect articles 22 from cutting damage when package 20 is opened. Edge 45 is disposed inboard of edge 46 for packages of cylindrical objects such as rolls of toilet paper so that the corners of the rectangular-shape support panel do not extend beyond the round corners of the package: reference FIGS. 1 and 2.

Figure 6:
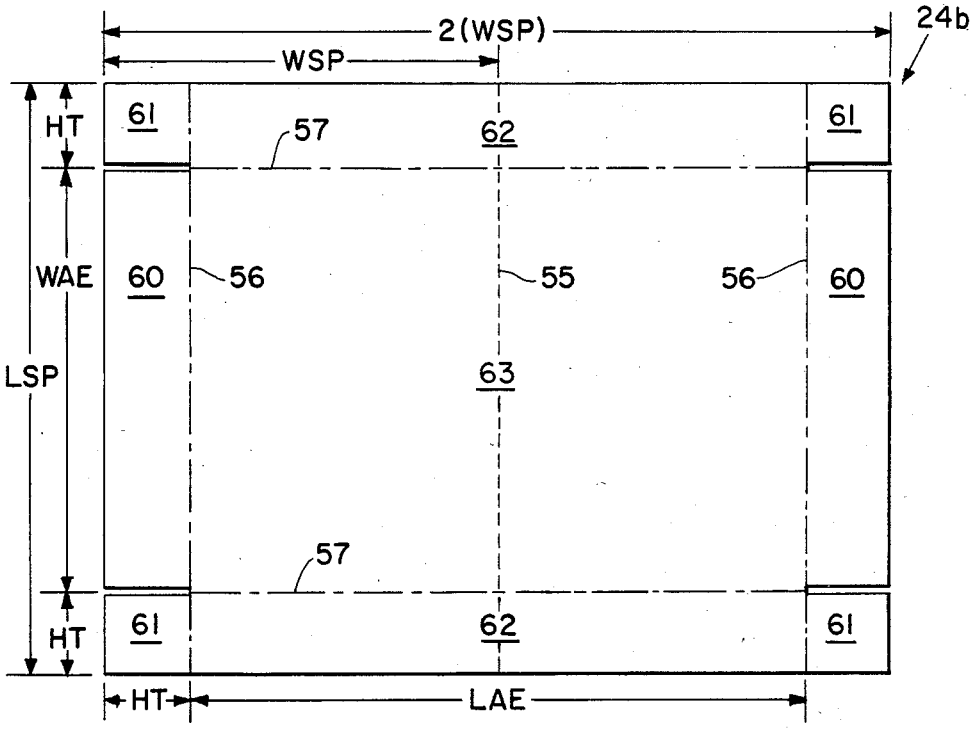
FIG. 6 is a plan view of a blank of corrugated cardboard which, when U-folded, is the support panel which constitutes the bottom wall of the package shown in FIG. 1.

FIG. 6 is a plan view of a blank **24*b* of foldable structural panel material such as but not necessarily corrugated cardboard. When U-folded along line 55, the blank is in fact the support panel 24 described above. The designator for blank 24*b* is the designator for support panel 24 with a suffix b. The blank is preferably so configured that: its length is equal to two times the width WSP of support panel 24, and its length is also equal to the Length of the Array Expanded (LAE) plus two times the height (HT) of the display tray; and its width is equal to the length LSP of the support panel 24, as well as the width being equal to the Width of the Array Expanded (WAE) plus two times the height (HT) of the display tray. Therefore, when the blank is U-folded along line 55, it has a double thickness for its full extent. Additionally, still referring to FIG. 6, lines 56 and 57 are preferably scored lines along which the blank is later folded to convert it from a support panel to a display tray as further described hereinafter. Briefly, however, fold lines 56 demark tray end walls 60, and corner tabs 61; and fold line 57 demark tray side walls 62 from the remainder 63 of the blank which remainder 63** ultimately becomes the bottom wall of the display tray.

FIG. 7 is a perspective view of a display tray 24DT which has been made from a support panel 24, FIG. 1, by unfolding the support panel to reconvert it into a blank **24*b*, FIG. 6; and by then folding it along score lines 56 and 57, and securing together face-to-face surfaces of the tray end walls 60 and side walls 62 to corner tabs 61** as with adhesives. Alternatively, the end walls and corner tabs can be configured to interlock as is well known in the folding box art. It is, however, not intended to limit the present invention to any particular means for securing the walls of the tray to corner tabs or the like to convert a convertible support panel blank to a display tray.

Still referring to FIG. 7, the display tray 24DT has internal length and width of LAE (i.e.: Length, Array Expanded) and WAE (i.e.: Width, Array Expanded), respectively, as stated above. That is, whereas the blank **24*b*, FIG. 6, is sized and configured to be folded and placed in package 20 with the compressed array of resilient articles 22, it is sized and configured to be converted into a display tray for the array after the array has expanded due to the resilience of the articles upon removal of the constraining enclosure 26**.

FIG. 8*a* is a sectional view of package 20 taken along section line 8*a*—8*a* of FIG. 1; and FIGS. 8*b*, 8*c* and 8*d* are sequential views which depict the preferred sequence of unpackaging a package 20. Essentially, in FIG. 8*b*, the bottom-end-edge portion 27 of enclosure 26 has been severed from the remainder of the enclosure 26. The bottom-edge portion of the remainder adjacent the line of severance is designated 27*a*, and is shown oriented in an upstanding disposition in FIG. 8*b* to uncover the support panel 24. The bottom-edge-portion 27 of enclosure 26 remains adhered to the outwardly facing surface of support panel 24 as described above.

Referring now to FIG. 8*c*, edge portion 27*a* has been doubled downwardly to expose the adjacent bottom ends of articles 22, but still remains disposed to substantially maintain the array of articles constrained in its compressed state. Additionally, in FIG. 8*c*, display tray 24DT is shown to have been converted from support panel 24, FIG. 8*b*, as described above, and placed upside down over the upwardly facing bottom end of the array of articles 22 still constrained within enclosure 26.

The configuration shown in FIG. 8*d* is achieved by righting the configuration of FIG. 8*c*; and removing enclosure 26. Upon removal of enclosure 26, the array of compressed articles is shown to have expanded to substantially fill tray 24DT. Thus, the array of articles can be displayed for, for example, consumer selection in a store.

While the sequence depicted in FIGS. 8*a* through 8*d* show an embodiment of the invention wherein the support panel is disposed in face-to-face relation with the bottom surface of the array of articles, and that the bottom of the array is the portion of the array which is placed in the display tray, it is not intended to thereby limit the present invention although it is certainly preferred to so practice the present invention. Additionally, while the array of toilet tissue rolls may be compressed substantially diametrically with respect to the rolls orientation, it is not intended to thereby limit the invention to packages of X-Y compressible arrays to the exclusion of X-Y-Z compressible arrays: for example, cubes of foam rubber which are compressible in their length, width and height (i.e., XYZ) directions.

EXEMPLARY PACKAGE

An exemplary embodiment of the present invention was made which comprised a two-by-three-by-four array of 4-Packs 40 of toilet tissue rolls 22 with the axes of the rolls oriented parallel to the height dimension of the package; a U-folded support panel 24 of double faced corrugated cardboard made from three sheets of kraft paper having a basis weight of about twenty-six pounds per one-thousand-square feet (about 126.4 grams per square meter); and a three-mil (about 0.076 mm) polyethylene bag 26. The array was compressed about twelve percent by volume and so constrained by the polyethylene bag. The length and width of the package was twenty-four-and-one-half inches (about 62.2 cm) and sixteen-and-five-sixteenths inches (about 41.4 cm), respectively; and the length and width of the U-folded support panel was about twenty-three-and-one-eighth inches (about 58.7 cm) and sixteen inches (about 40.6 cm), respectively. The blank from which the support panel was folded was about thirty-two inches (about 81.3 cm) long and twenty-three-and-one-eighth inches (about 58.7 cm) wide; and was configured to form a display tray 24DT having inside length and width of about twenty-six-and-one-quarter inches (about 66.7 cm) and about seventeen-and-one-eighth inches (about 43.5 cm), respectively, and a height of about three inches (about 7.6 cm). Upon removal of the bag in accordance with the unpackaging sequence described hereinabove, the array expanded in its length and width dimensions to approximately the length and width, respectively, of the display tray due to the diametral resilience of the toilet tissue rolls. This was enabled by configuring the blank 24*b* so that the plan view size of the display tray was sufficiently greater than the plan view size of the support panel to accommodate the increase in array size realized upon removal to the constraining bag enclosure.

FIG. 9 is a plan view of a cut and scored blank 124*b* which is substantially identical to blank 24*b*, FIG. 6, except score lines 155 are disposed to enable C-folding of blank 124*b* whereas score line 55 of blank 24*b* is disposed to enable U-folding blank 24*b* as described above. Thus, it is not intended to limit the present invention to blanks having any particular fold geometry to form them into convertible support panels in accordance with the present invention. Accordingly, the portions and features of blank 124*b* which are functionally the same as corresponding portions and features of blank 24*b* are identically designated. That is, the end walls of both are designated 60, the side walls of both are designated 62, the corner tabs of both are designed 61, and the bottom walls of both are designated 63.

FIG. 10 is an edge view of a support panel 124 which has been formed by C-folding blank 124*b*, FIG. 9, along score lines 155. The folded edges of support panel 124, FIG. 10, are designated 145. For a given package, the plan size of a support panel 124 would preferably be the same as for a support panel 24.

FIG. 11 is a perspective view of an inverted package which is an alternate embodiment of the present invention. Essentially, it is like package 20, FIG. 1, except its enclosure 126 is a polyethylene bag having sufficient depth to enable folding and heat sealing the bottom end (upwardly facing in FIG. 11) as shown rather than adhesively sealing the open end edge of the bag to the marginal regions of the support panel as described hereinbefore in conjunction with describing package 20. The dashed-line 150 indicates a line which may be printed to read CUT ALONG THIS LINE TO REMOVE DISPLAY TRAY as was described hereinbefore with respect to line 50 on package 20, FIG. 4.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A package comprising:

a constrained array of radially compressed, radially resilient rolls of tissue paper product, each of said rolls comprising a length of tissue paper wound onto a cylindrical core having an axis of rotation, said rolls being disposed with their axes of rotation in parallel relation;

a convertible support panel disposed against an end of said array with said axes of rotation disposed perpendicular thereto, said support panel being a planar panel which is folded to have a plane size area no greater than said end of said constrained array, and sufficiently large to be unfolded and formed into a display tray of sufficient area to accommodate said end of said array when said array becomes unconstrained and expanded due to the radial resilience of said rolls of tissue paper;

an array constraining enclosure of flexible sheet material, said array being constrained by and within said enclosure with said rolls radially compressed until removal of said enclosure.

2. The package of claim 1 wherein said enclosure is a bag, said sheet material is a thermoplastic film, and said convertible support panel comprises folded corrugated cardboard.

3. The package of claim 2 wherein said convertible support panel comprises a U-folded blank of said corrugated cardboard.

4. The package of claim 2 wherein said convertible support panel comprises a C-folded blank of said corrugated cardboard.

5. The package of claim 1 wherein said rolls are rolls of toilet tissue.

6. The package of claim 1 wherein said rolls are rolls of disposable paper towels.

7. The package of claim 1 wherein said array comprises packaged sub-arrays of said rolls of tissue paper.

8. The package of claim 7 wherein said rolls are rolls of toilet tissue.

9. The package of claim 7 wherein said rolls are rolls of disposable paper towels.

10. The package of claim 1 wherein edge regions of said sheet material of said enclosure are secured to marginal regions of the outwardly facing surface of said convertible support panel.

11. The package of claim 1 wherein said enclosure is a thermoplastic bag, and wherein said support panel is disposed intermediate the bottom end of said array and the adjacent closed bottom end of said bag.

12. A method of unpackaging a package comprising an array constraining enclosure of sheet material, an array of compressed resilient articles constrained within said enclosure, and a convertible support panel juxtaposed the bottom end of said array, said support panel being convertible to form a display tray of sufficient size to accommodate said array upon said array becoming unconstrained and expanded due to the resilience of said articles when said enclosure is removed, said method comprising the steps of:

orienting the package so that said support panel faces upwardly;

releasing said support panel from said package while continuing to constrain said array within said enclosure;

converting said support panel into said display tray;

placing said display tray bottom-side up over the upwardly facing bottom end of said array; righting said array, enclosure, and display tray as a unit; and removing said enclosure to release said constraining of said array.

* * * * *